US009637346B2

(12) United States Patent
Connell

(10) Patent No.: US 9,637,346 B2
(45) Date of Patent: May 2, 2017

(54) REELS WITH SLITTED FLANGES

(71) Applicant: Carris Reels, Inc., Proctor, VT (US)

(72) Inventor: Brian Connell, Dalesville, VA (US)

(73) Assignee: Carris Reels, Inc., Proctor, VT (US)

( * ) Notice: Subject to any disclaimer, the term of this patent is extended or adjusted under 35 U.S.C. 154(b) by 344 days.

(21) Appl. No.: 14/278,516

(22) Filed: May 15, 2014

(65) Prior Publication Data

US 2015/0329311 A1 Nov. 19, 2015

(51) Int. Cl.
*B65H 75/14* (2006.01)
*B65H 75/22* (2006.01)

(52) U.S. Cl.
CPC ..... *B65H 75/145* (2013.01); *B65H 75/14* (2013.01); *B65H 75/22* (2013.01); *B65H 2701/5122* (2013.01); *B65H 2701/5136* (2013.01)

(58) Field of Classification Search
CPC ..... B65H 75/145
USPC ..... 242/605
See application file for complete search history.

(56) References Cited

U.S. PATENT DOCUMENTS 8,328,127 B2 * 12/2012 Ito ..... B65H 75/14 242/118.6
2009/0218436 A1 * 9/2009 Charron ..... B65H 75/14 242/604
2012/0104147 A1 * 5/2012 Cox ..... B65H 75/14 242/614

* cited by examiner

*Primary Examiner* — William E Dondero
(74) *Attorney, Agent, or Firm* — The H.T. Than Law Group

(57) ABSTRACT

The present invention pertains to a single-piece flange adapted to be a part of a reel or spool, wherein the flange includes: (a) a hub portion defining one or more apertures, wherein the hub portion comprises an outer face and a wire face; (b) an outer rim; (c) a side wall disposed between the hub portion and the outer rim, wherein the side wall comprises an outer face and a wire face, and a plurality of crack propagation inhibitors extending through a thickness of at least the sidewall; and (d) a plurality of ribs connected to the side wall, and extending toward the hub portion.

23 Claims, 15 Drawing Sheets

REELS WITH SLITTED FLANGES

FIELD OF THE INVENTION

This invention generally relates to reels or spools designed to carry cables, wires, such as optical, electrical, telephone or communication wires, other stranded materials, or the like, and more specifically to flanges with structures that can stop the propagation of cracks occurring in the material of the flange.

BACKGROUND OF THE INVENTION

Flanges for spools and reels have been known for a long time. Exemplary of such flanges are disclosed in U.S. D281,482 to Suzuki et al, U.S. Pat. No. 3,565,363 to Mizuguchi et al., U.S. Pat. No. 5,474,254 to Faulkner, U.S. Pat. No. 1,911,427, U.S. Pat. No. 5,169,086, U.S. D330,506, U.S. Pat. No. 2,597,139, U.S. Pat. No. 4,512,532, U.S. Pat. No. 5,464,171, and U.S. Pat. No. 6,450,441, among others such as U.S. Pat. No. 8,567,037 B2 and commonly owned U.S. Pat. No. 8,640,981. These patents are incorporated herein by reference in their entireties. Corrugations and ribs are added to the flanges to provide the flanges with more structural integrity, among other properties.

For example, U.S. Pat. No. 5,464,171 to Ripplinger discloses a reel 180 that rotates about an axis 181, wherein the reel includes a tube 182 that attaches to flanges 184 as shown in FIG. 1 of the present application. U.S. Pat. No. 5,464,171 is incorporated herein by reference in its entirety. The flanges 184 are provided with radially oriented solid, linear ribs 188, 198 that have one longitudinally unattached edge. Flanges 184 are joined to a barrel 182 to form a reel 180. As is known in the art, such linear ribs are a substantially different structure than corrugations, such as those corrugations disclosed in U.S. Pat. No. 8,567,037 B2.

One problem encountered with prior art reels is that cracks from impacts with the ground may form in the flanges and propagate during use, which may result in undesired structural or functional failure(s) of the reels. Such failure can result in the release of the wires or cables stranded in the reels. The prior art needs meaningful structure to minimize the propagation of these cracks.

SUMMARY OF THE INVENTION

It is an object of the present invention to provide flanges that overcome this deficiency in the prior art reels by providing one or more voids or slits, and/or other crack propagation inhibiting structures, in the flange to prevent and/or inhibit the propagation of a crack or cracks that may form in the flange.

Hence, the present invention is directed to reek or spools for carrying cables, wires or other stranded materials, wherein the flanges of these reels or spools have crack propagation inhibitors, such as voids or slits, selectively formed on or in the side wall of the flange. These crack propagation inhibitors are configured to minimize, or at least inhibit, the propagation of cracks that form in the side wall of the flange, caused by impacts and the like, by providing a space across which a crack may not propagate. The ability of the crack propagation inhibitors to prevent, or at least inhibit, crack propagation in the side wall of the flange is ideally independent of the etiology of the crack formation. Cracks may form, for example, due to an accidental impact on the flange, or due to changes in ambient temperature, or due to normal wear and tear experienced by the flange.

Preferably, crack propagation inhibitors comprise slits, voids, holes, or elongated openings, formed on or in the flange, although other structures that inhibit crack propagation may be employed.

The present invention may also have ribs dispersed on the side wall of the flange in order to provide additional structural integrity to the flange. These ribs can be attached to either the outer face, or the wire face, or both the outer face and the wire face, of the flange and may have various geometries that are sufficient to increase structural integrity of the flange. Such ribs may also define some of the crack propagation inhibitors.

BRIEF DESCRIPTION OF THE DRAWINGS

In the accompanying drawings, which form a part of the specification and are to be read in conjunction therewith and in which like reference numerals are used to indicate like parts in the various views:

FIG. 2(*b*) is an isometric inside view of the inventive flange of FIG. 2(*a*); and FIG. 2(*c*) is a side view of the inventive flange that shows a tab member.

FIG. 3(*b*) is an enlarged view of FIG. 3(*a*); and FIG. 3(*c*) is a cross-sectional view along line B-B of FIG. 3(*a*) to show the T-configuration of the ribs connected to the side wall;

FIG. 4(*b*) is an enlarged view of the side wall embodiment of FIG. 4(*a*); and FIG. 4(*c*) is a cross-sectional view along line C-C of FIG. 4(*a*) to show the L-configuration of the ribs connected to the side wall;

DETAILED DESCRIPTION OF THE PREFERRED EMBODIMENTS

Figure 1:
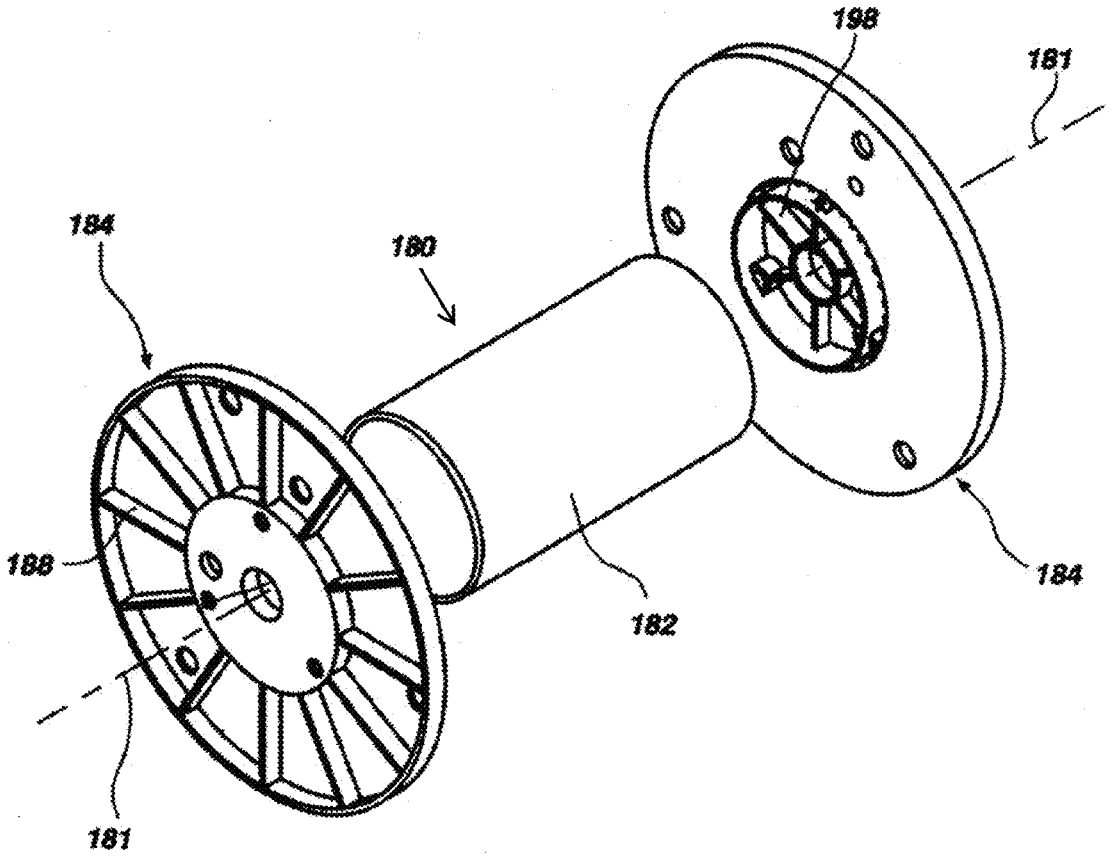
PRIOR ART FIG. 1
FIG. 1 illustrates a prior art spool assembly.
Figure 2A:
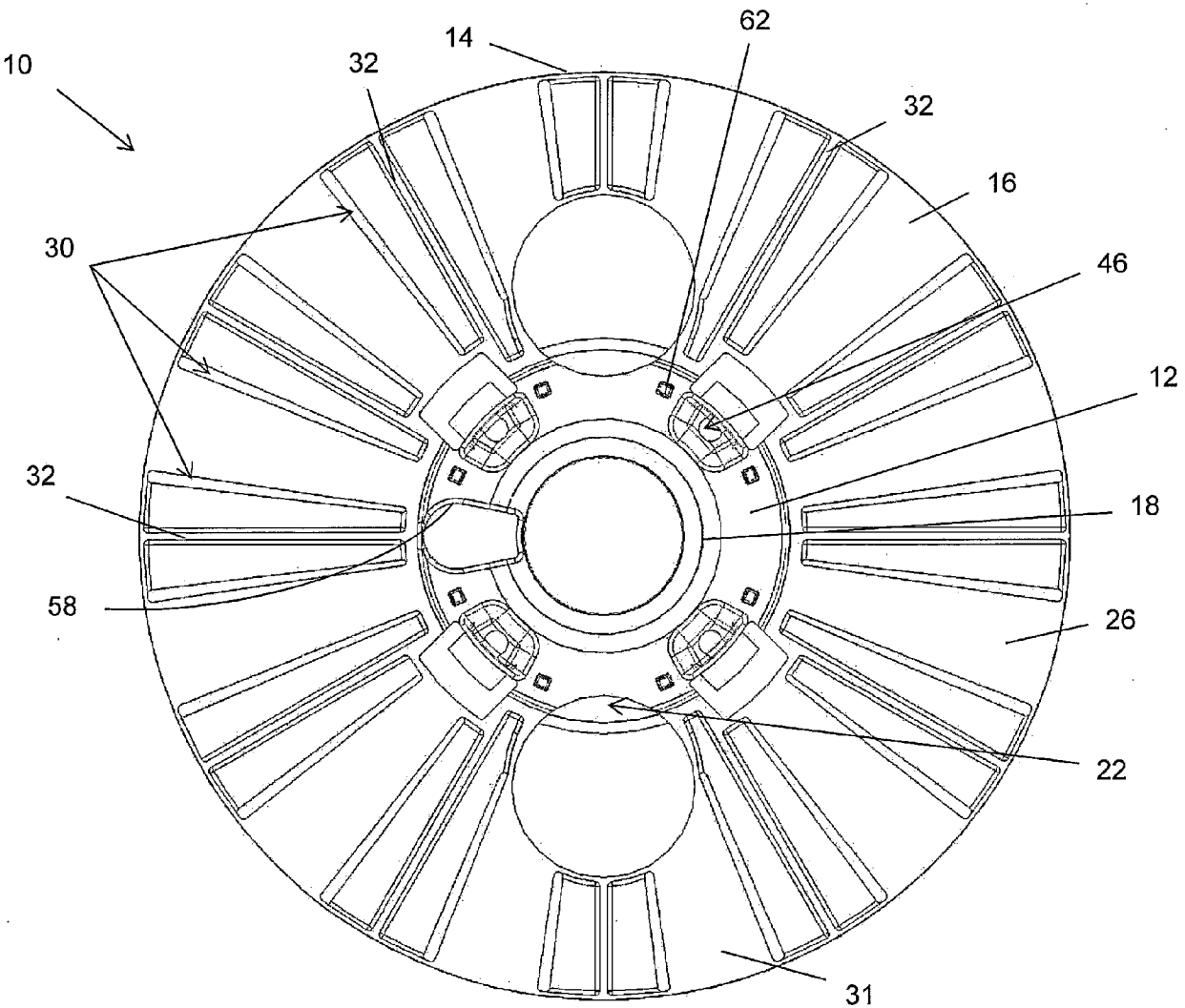
FIG. 2(*a*) is a top outside face of an inventive flange of the present invention illustrating a T-configuration of the ribs.
Figure 2B:
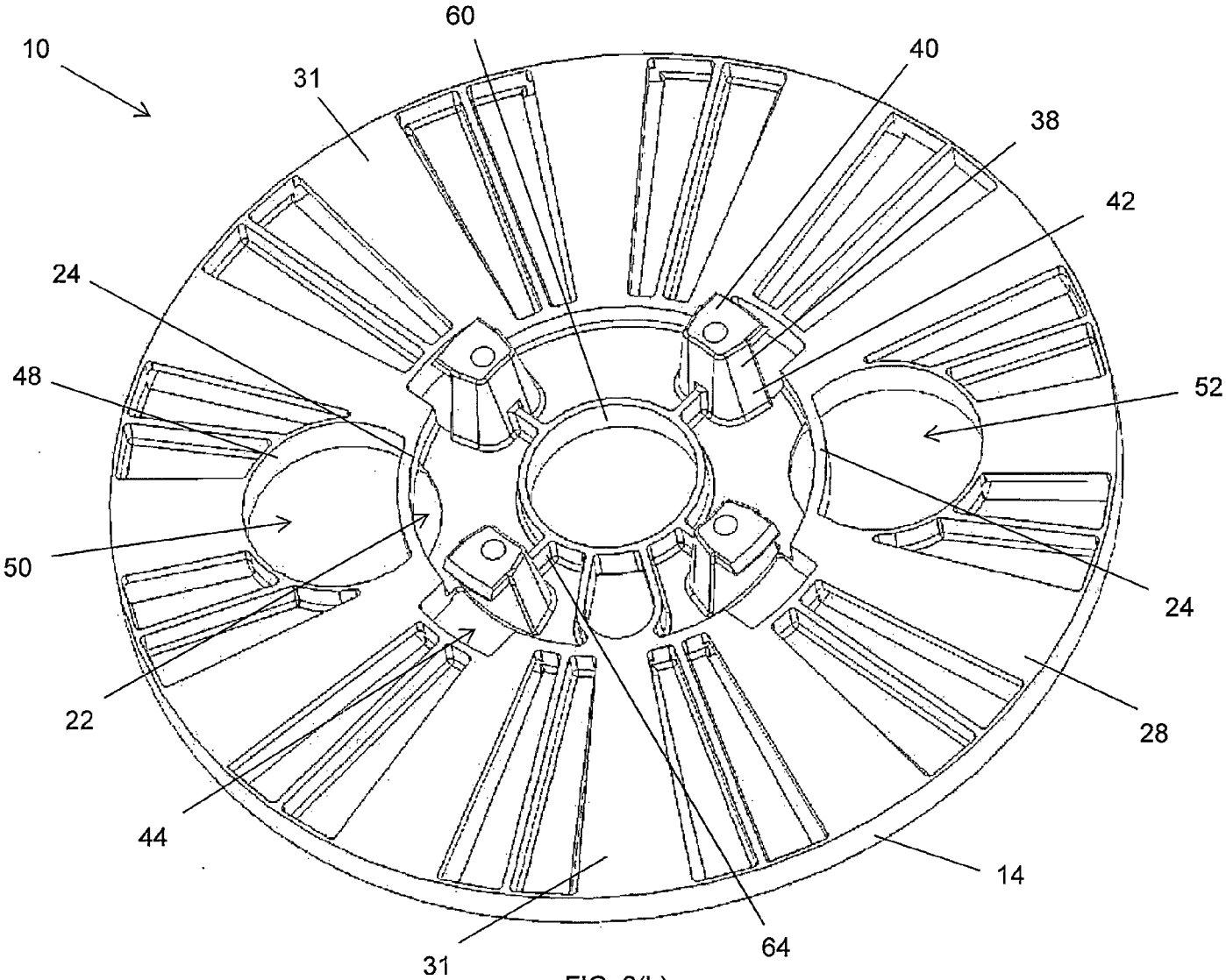
Figure 2C:
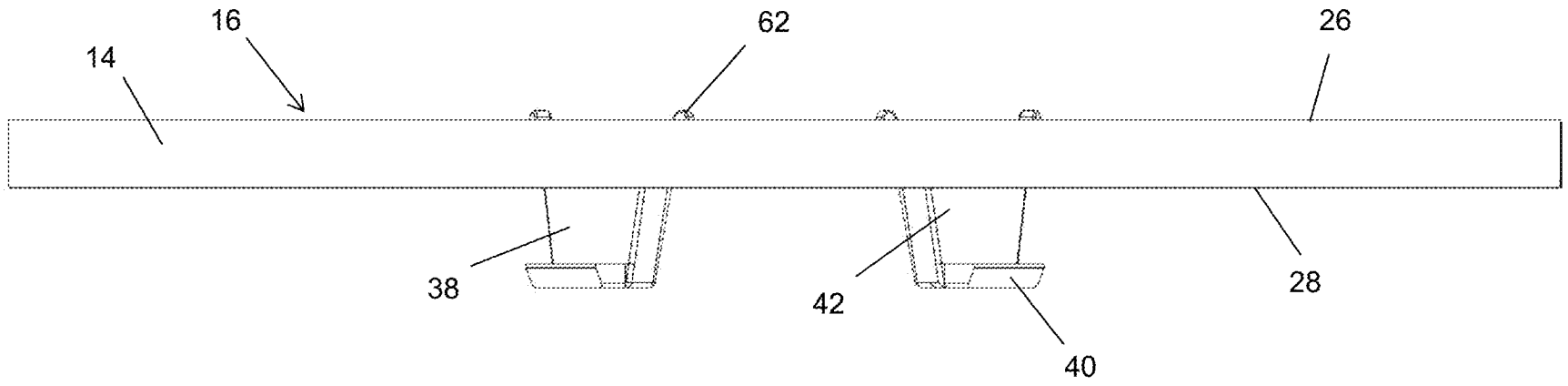
Figure 3A:
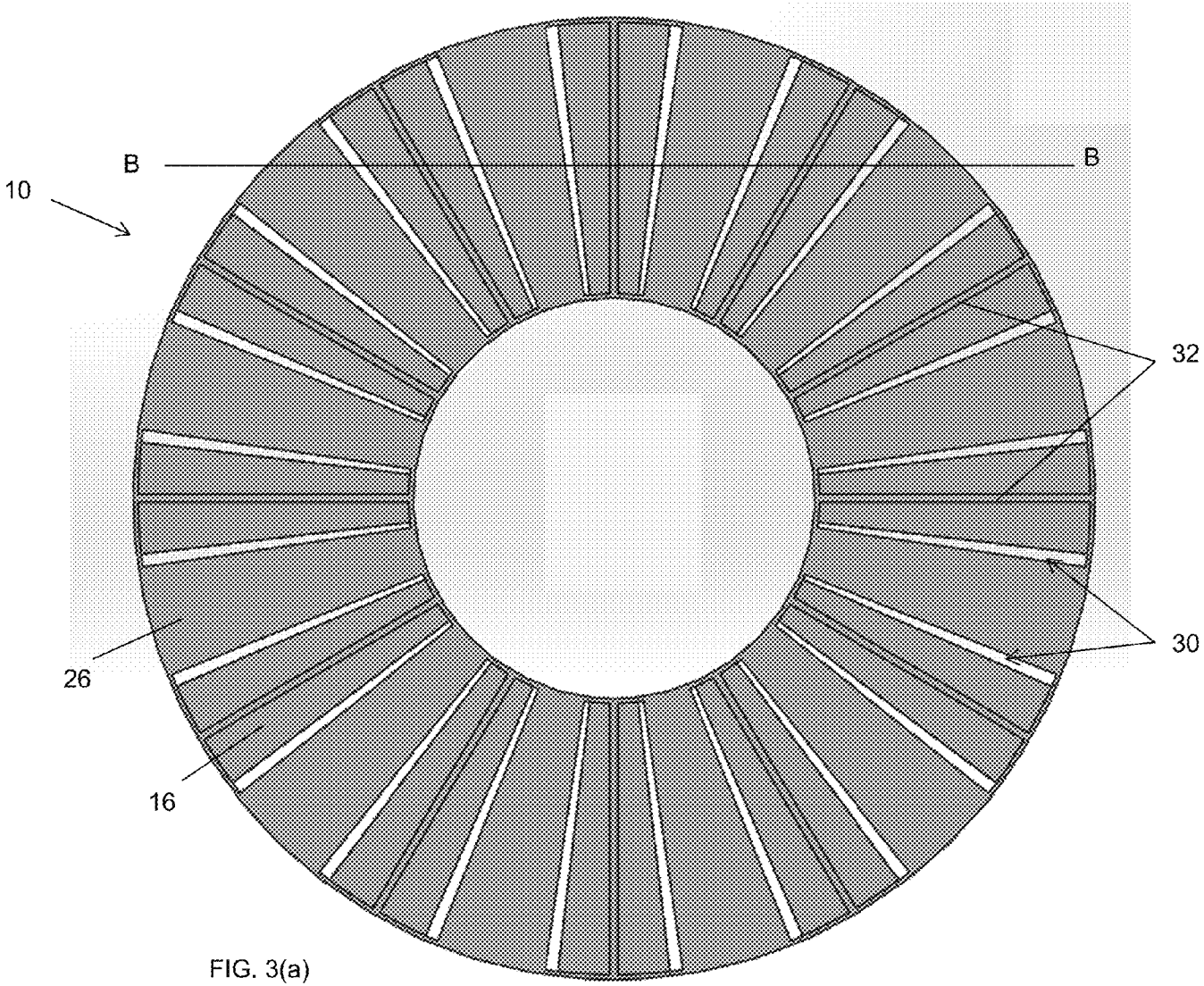
FIG. 3(*a*) is a top view of the outside face of the inventive flange of the present invention illustrating a T-configuration of the ribs connected to the side wall.
Figure 3B:
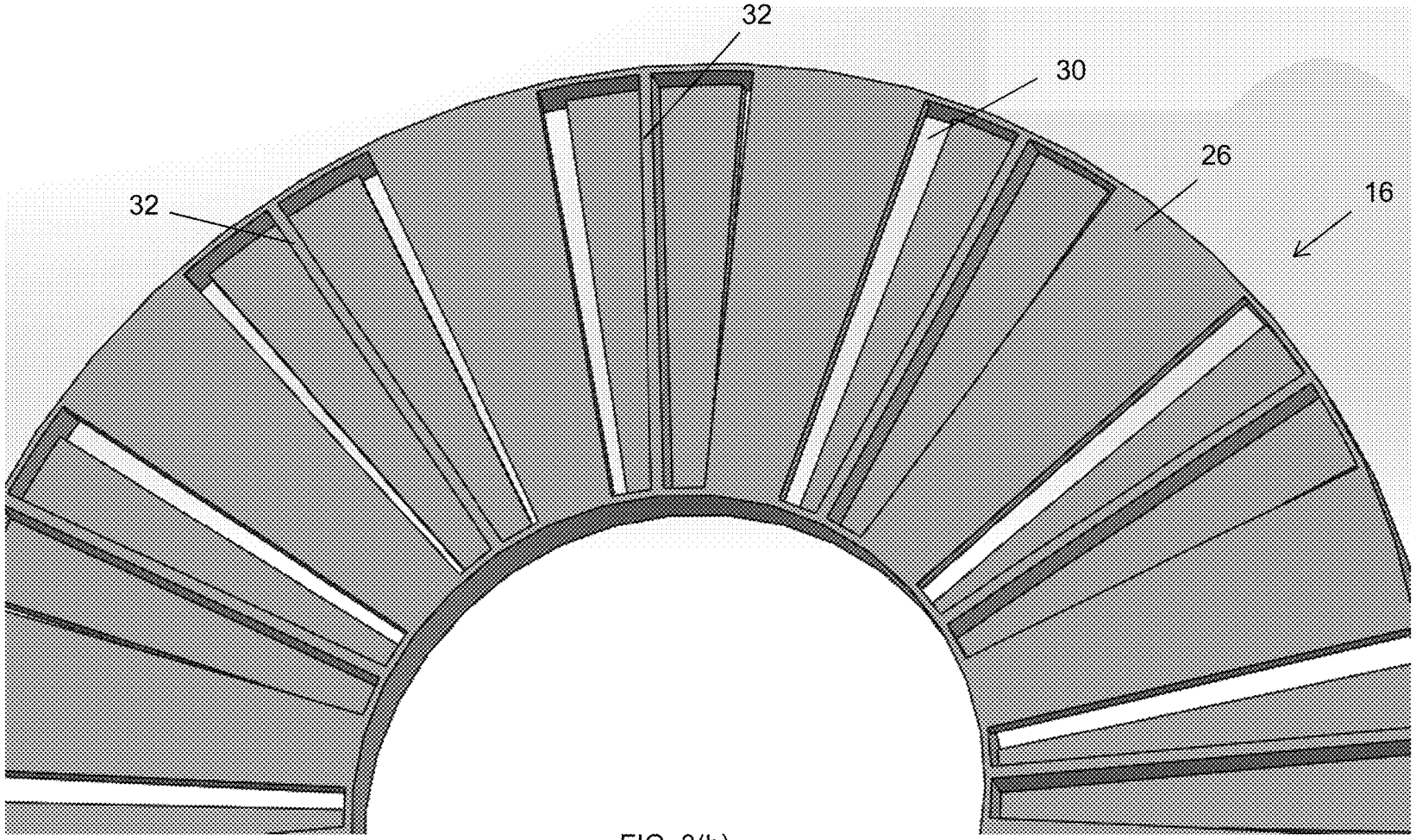
Figure 3C:
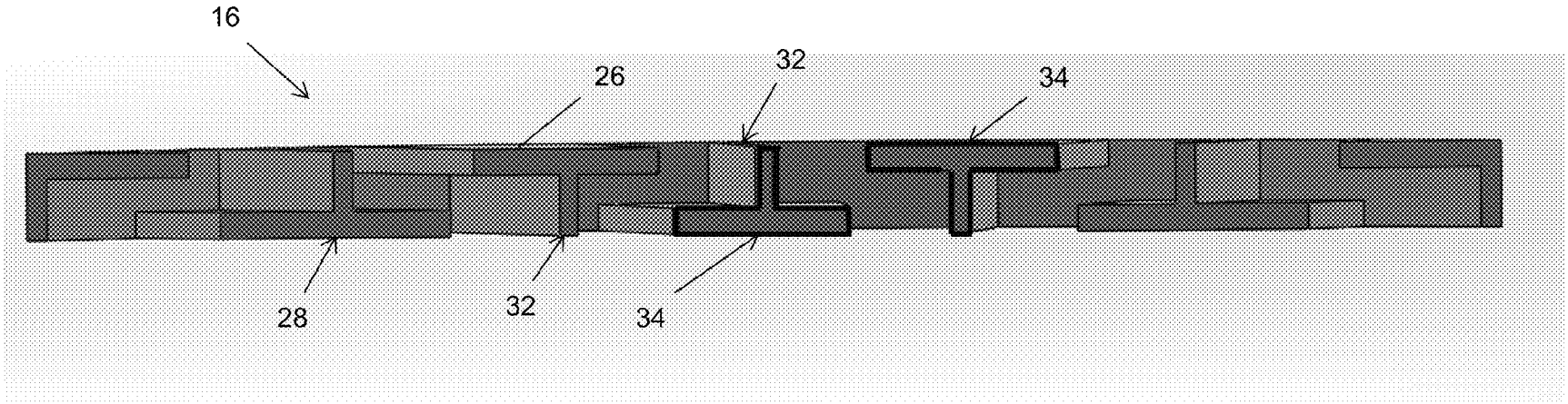

As illustrated in the accompanying drawings and discussed in detail below where like parts are designated by like referenced numbers, the present invention is directed to flange 10 for use with reels or spools. Generally, a tube, similar to barrel 182 shown in FIG. 1, is connected to one flange 10 at each end, and wires, or cables, are wounded on the tube and contained by flanges 10. FIG. 2(*a*) shows outside surfaces of the flanges, i.e., the side away from and not contacting the wires or cables, and FIG. 2(*b*) shows the inside surface, i.e., the side contacting the wires. FIGS. 3(*a*), 3(*b*), 3(*c*), 4(*a*), 4(*b*), and 4(*c*) can be either the inside or outside surfaces.

Referring to FIGS. 2(*a*)-(*c*), a unitary or single-piece flange 10 comprises hub or core 12, outer rim 14 and side wall 16. Hub 12 is attached at each end of a tube (not shown), similar to tube 182, upon which the wire or other stranded objects are wound. A reel or spool is formed by attaching a flange on each end of a tube. Hub 12 can have any features, including arbor 18 and one or more apertures 20 defined within the hub. The hub 12 also includes a middle rim 24 that has a circumference that is larger than the circumference of the arbor 18. The tube or barrel is received within the middle rim 24.

Figure 6:
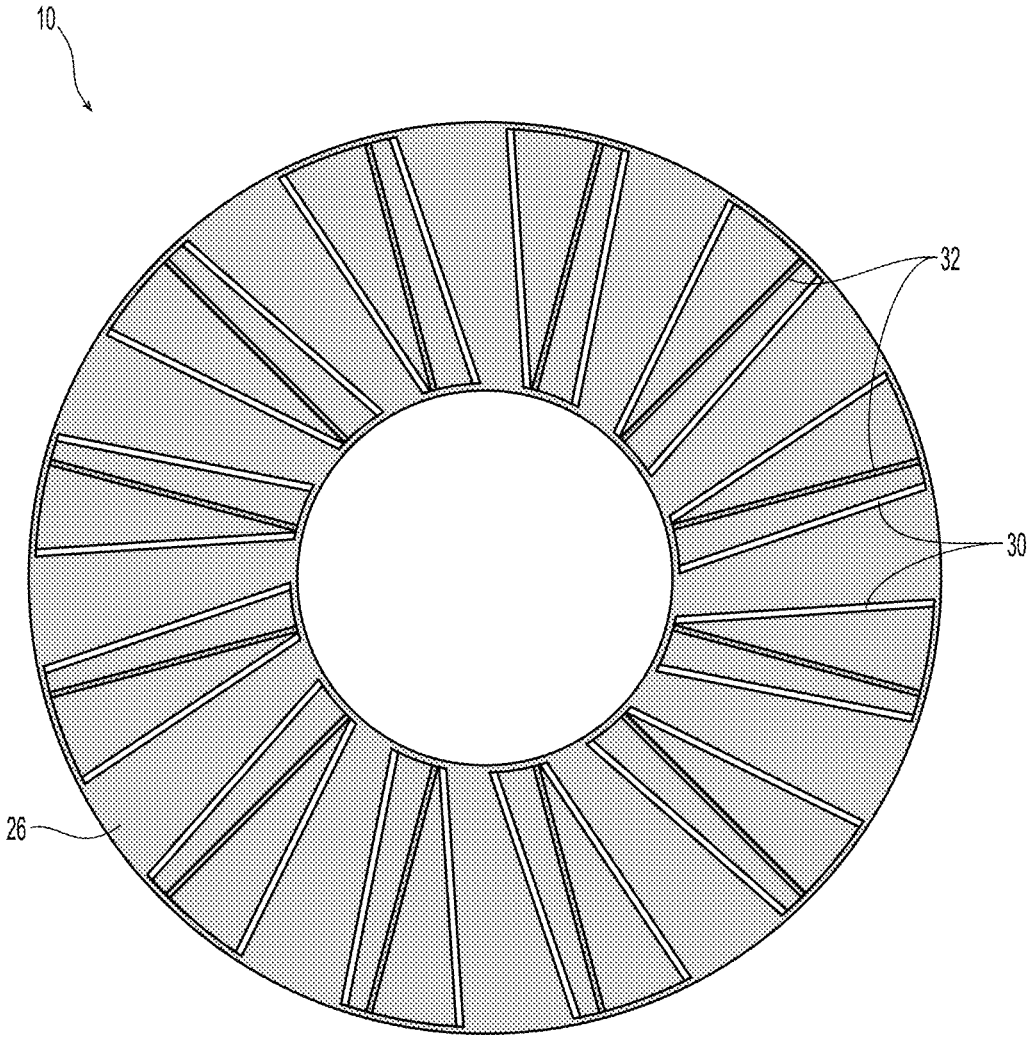
FIG. 6 is a top view illustrating another embodiment of the present invention with skewed linear slits (i.e., linear slits possessing both a radial and circumferential component)
Figure 7:
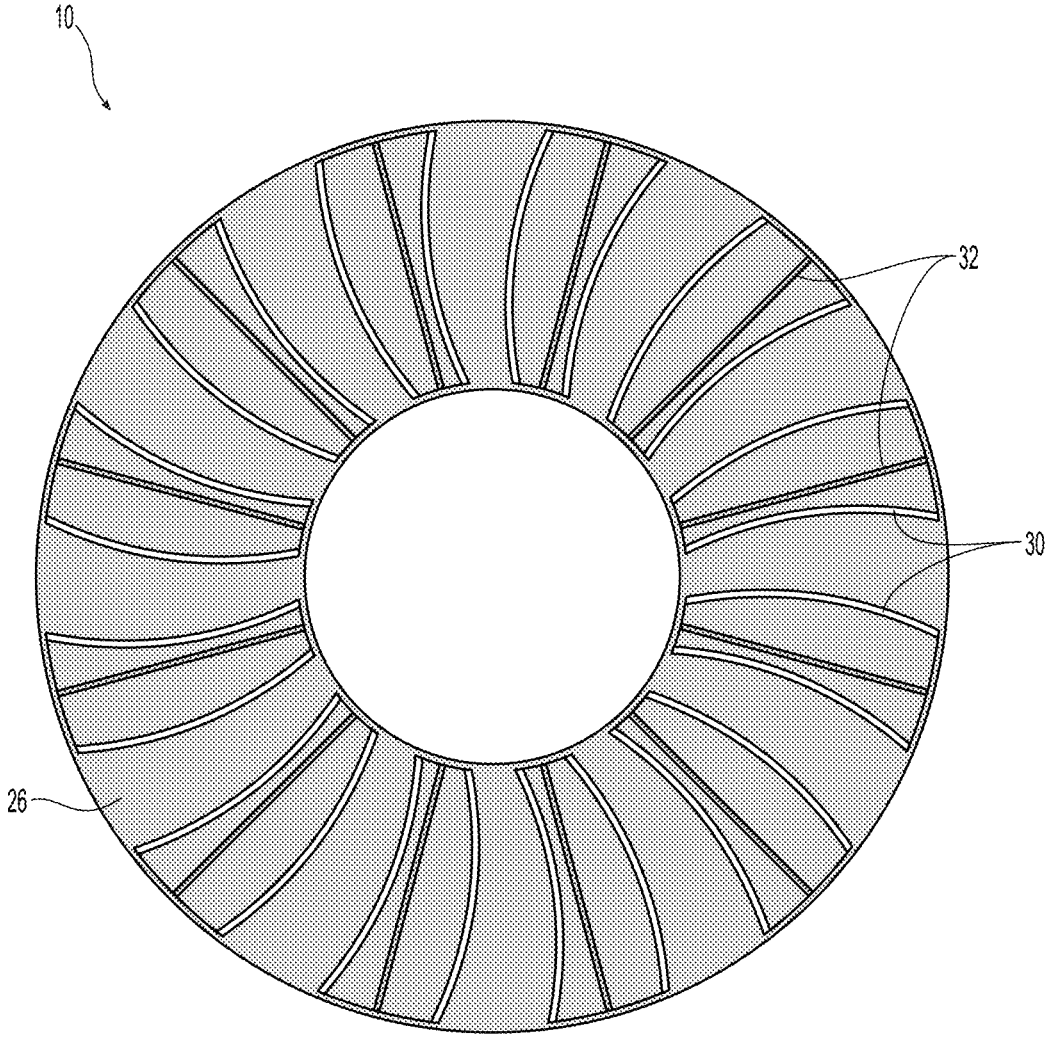
FIG. 7 is a top view illustrating another embodiment of the present invention with non-linear arcuate slits.
Figure 8:
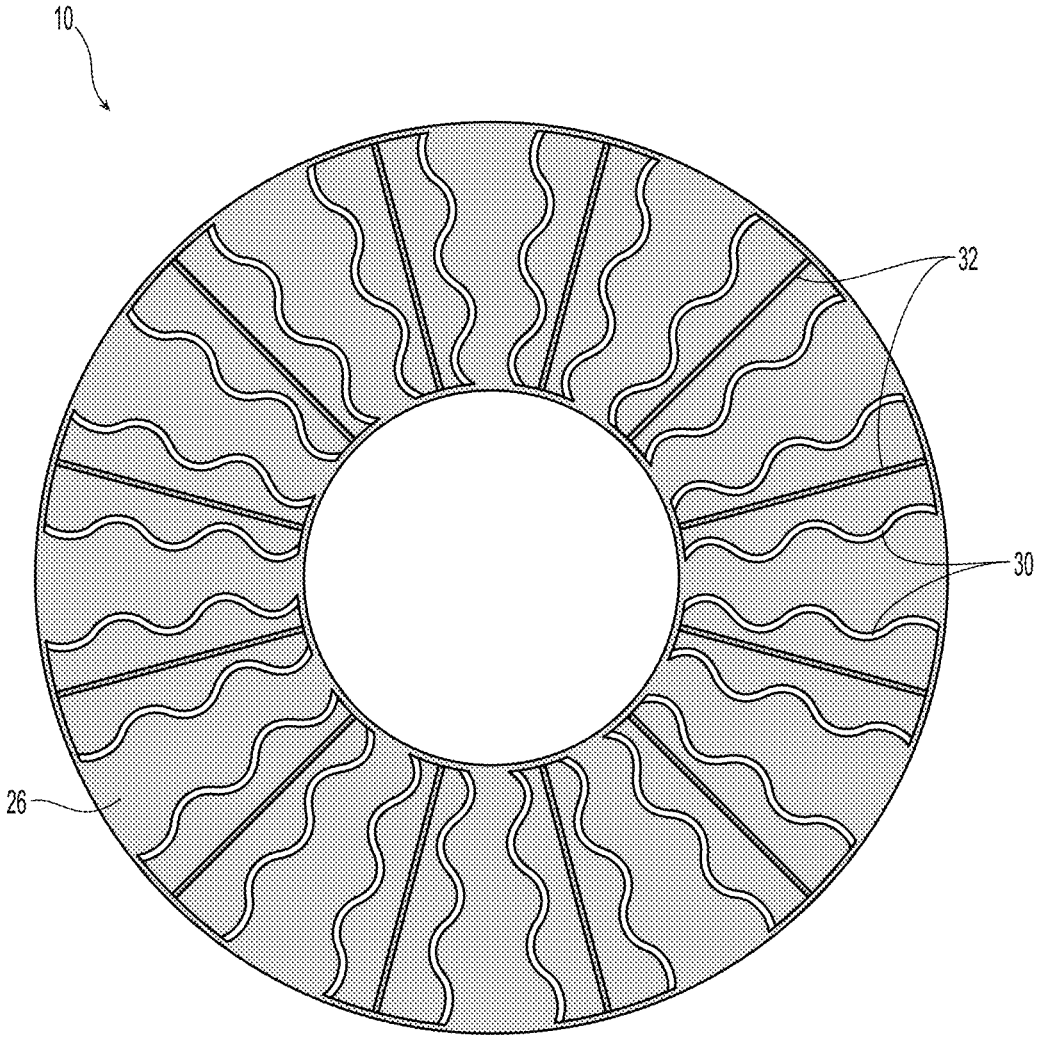
FIG. 8 is a top view illustrating another embodiment of the present invention with non-linear snakelike or serpentine slits.

The side wall 16 is disposed between middle rim 24 and the outer rim 14 and connects these structures. The side wall 16 has an outer face 26 shown in FIG. 2(*a*) and a wire face 28 shown in FIG. 2(*b*), and is provided with a plurality of crack propagation inhibitors 30 extending through the thickness of the side wall 16. Crack propagation inhibitors preferably are slits or elongated openings as shown. Each slit 30 may extend from the outer rim 14 to the middle rim 24 or less, although some of the slits may have lengths that are substantially different from the lengths of some of the other slits. The slits may preferably extend radially from the outer rim 14 towards the center of the flange 10 (i.e., the center of the arbor 18). However, it is not required that the slits extend substantially radially toward the center of the arbor 18 or its central aperture. It is within the scope of the present invention for the slits 30 to extend at an angle skewed with respect to the radius of the flange as shown in FIG. 6, so that the slits 30 have a radial and circumferential component. Furthermore, the slits may be linear as shown in FIG. 2(*a*), or non-linear as shown in FIG. 7. FIG. 8 illustrates slits 30 that have a curvilinear sinuous or snakelike geometry. Such serpentine slits 30 may inhibit or eliminate the propagation of shock from the outer rim 14 to the tube or barrel received in the middle rim 24.

The purpose of the crack propagation inhibitors, such as the non-limiting example of slits 30, is to provide a space, or material void, that prevents or inhibits the propagation of cracks that have formed in the side wall 16 of the flange 10. Although not bound by a particular theory, cracks in solid materials may propagate, as described by David Roylance, Introduction to Fracture Mechanics, Massachusetts Institute of Technology (2001), when a crack has grown into a solid material to a particular depth, so the regions of material adjacent to the free surfaces of the crack are unloaded and their strain energy is released. On the other hand, the remaining material at the crack-tip continues to experience full stress, and this strain energy may be released by crack growth. As the crack grows longer, a quadratic dependence on strain energy eventually dominates the surface energy and, beyond a critical crack length, the system can lower its energy by propagation of the crack. Thus, once the crack length reaches the critical crack length, crack growth becomes spontaneous and catastrophic.

To prevent, inhibit or limit this propagation of stress and energy from the crack-tip further into the material of a flange 10, crack propagation inhibitors 30, which may be embodied as a space, or other material void such as a slit, are provided in the side wall 16 of the flange 10 to interrupt this propagation of stress and energy through the material, thereby preventing or inhibiting further propagation of the crack. As evident from FIGS. 2(*a*), 2(*b*) and 5-7, the slits 30 effectively divide the sidewall of the flange 10, 11 into discrete crack propagation inhibiting segments or webs 31 (i.e., the regions between two adjacent slits). These segments 11 inhibit crack propagation because cracks forming in one of these regions will not propagate across the slits 30 into an adjoining segment because when a crack propagates to the slit boundary of its segment, the crack's stress and energy are released, thereby prohibiting further propagation of the crack in other words, a crack needs material in order to propagate. Crack propagation inhibitors 30 provide spaces or voids of material across which a crack should not propagate.

In order to enhance structural integrity of the slitted flange 10, the side wall 16 is provided with a plurality of ribs 32 that are preferably connected on one longitudinal side to the side wall 16. Each rib 32 extends generally towards the hub 12 from the outer rim 14. As shown in FIGS. 2(*a*) and 2(*b*), each rib 32 may extend in a radial direction towards the center of the arbor 18. However, it is not required that the ribs 32 extend solely in the radial direction; as they may also have a circumferential component. In accordance with the present invention, ribs 32 may be skewed from the radial direction, although they are preferably linear, and may have a geometry similar to slits 30 shown in FIG. 6. Non-linear ribs may also be used to improve structural integrity of the side wall of the flange, and may have a geometry similar to slits 30 illustrated by FIG. 7. Beside structural supports such as ribs 32, the side wall 16 may be provided with other kinds of structural supports in addition to, or in place of, the ribs, such as corrugations and/or regions of enhanced or increased wall thickness.

However, in accordance with one aspect of the present invention, the term "rib" is specifically defined as a structure having at least one unattached longitudinal edge. Furthermore, a "rib" as defined by the present disclosure is not a "corrugation" as that term is defined by U.S. Pat. No. 8,567,037 B2 and by its prosecution history, which is the prosecution history of U.S. patent application Ser. No. 13/612,976, both of which are incorporated herein by reference in their entireties.

Each rib 32 may extend from the outer rim 14 to the middle rim 24, although some of the ribs may have lengths that are substantially different from the lengths of some of the other ribs, and it is not required that any of the ribs 32 extend fully from the outer rim 14 to the middle rim 24. Therefore, it is not required that the ribs 32 all have the same length, although they may all have the same length. Furthermore, all of the ribs 32 may be attached to the outer face 26 of the side wall 16, or all of the ribs 28 may be attached to the wire face 28 of the side wall 16, or some of the ribs may be attached to the outer face 26 and some of the ribs may be attached to the wire face 28 of the side wall 16. Preferably, the ribs 32 are connected to the side wall 16 so that every other rib is attached to the outer face 26 of the side wall 16 and the rest of the ribs are attached to the wire face 28 of the side wall 16 as shown in FIGS. 3(*c*) and 4(*c*). Such an alternating configuration of ribs 32 on the outer and wire faces of the side wall 16 is preferred because it provides the highest degree of symmetry for the side wall 16, which provides an optimal moment of inertia for the flange 10, which may be rotated at high speeds during use. Ribs 32 can also be attached to the hub portion 12 on the wire side 28, or on the outer surface 26, or both.

Figure 4A:
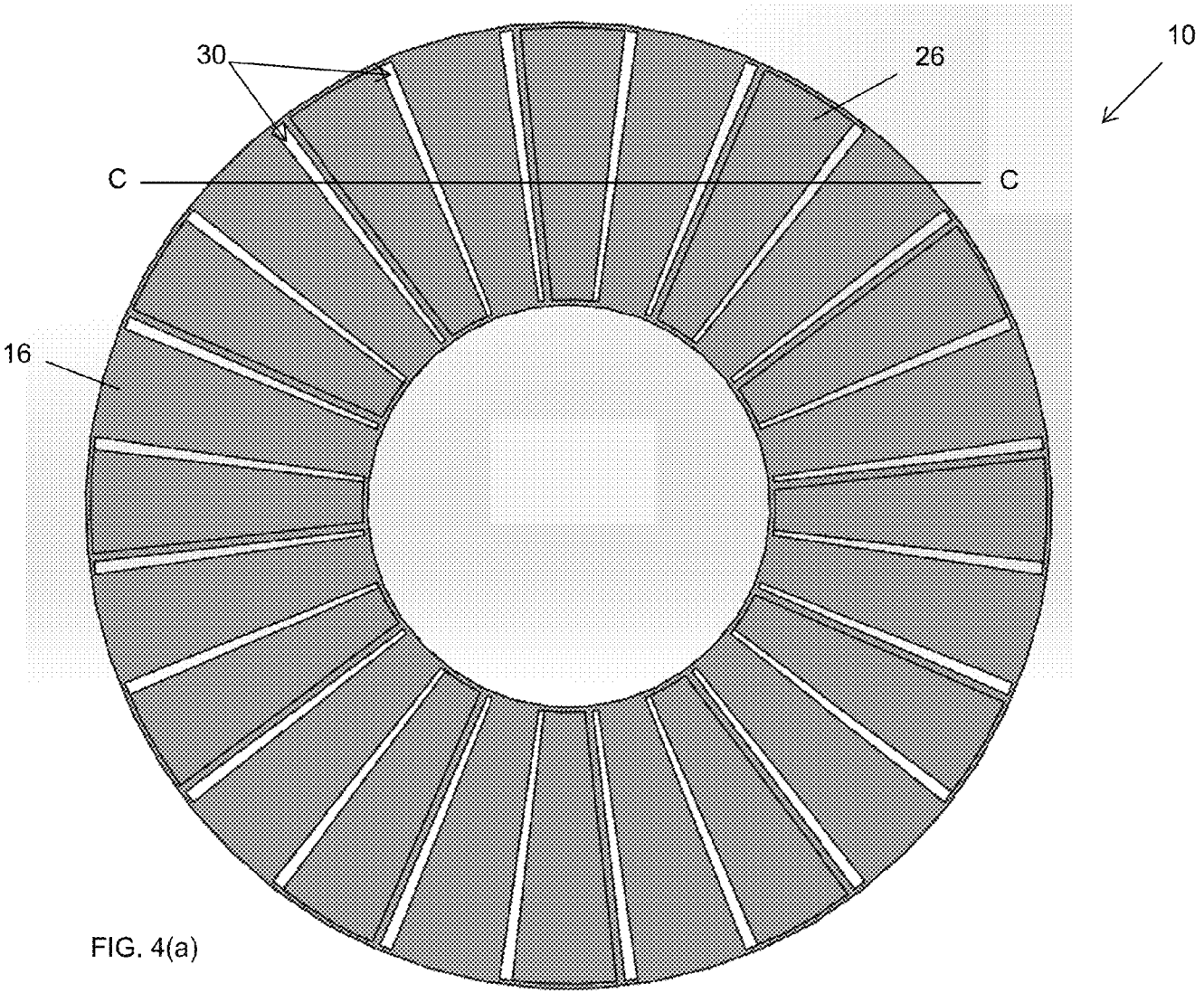
FIG. 4(*a*) is a top view of the outside face of the inventive flange of the present invention illustrating an L-configuration of the ribs connected to the side wall.
Figure 4B:
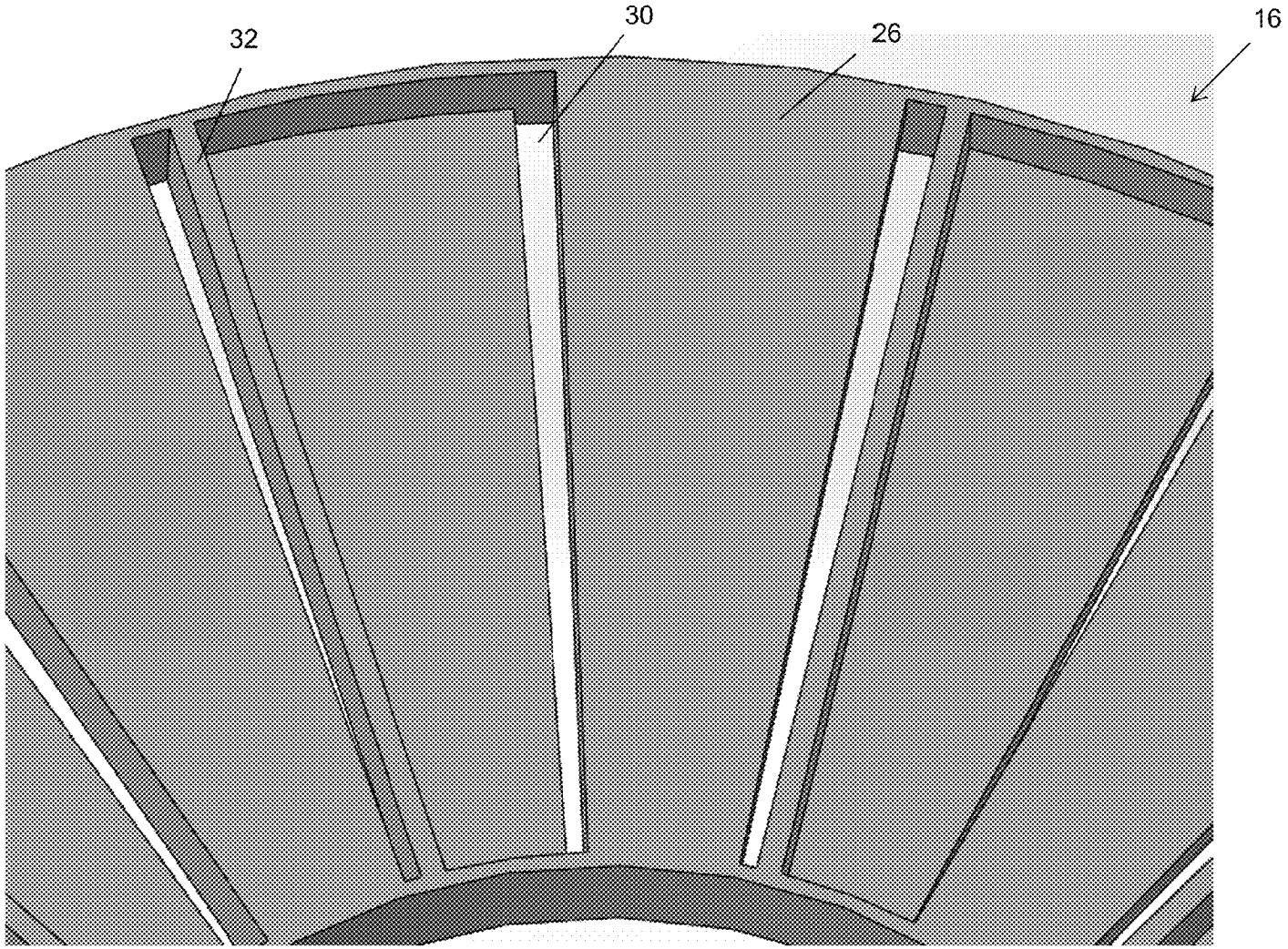
Figure 4C:
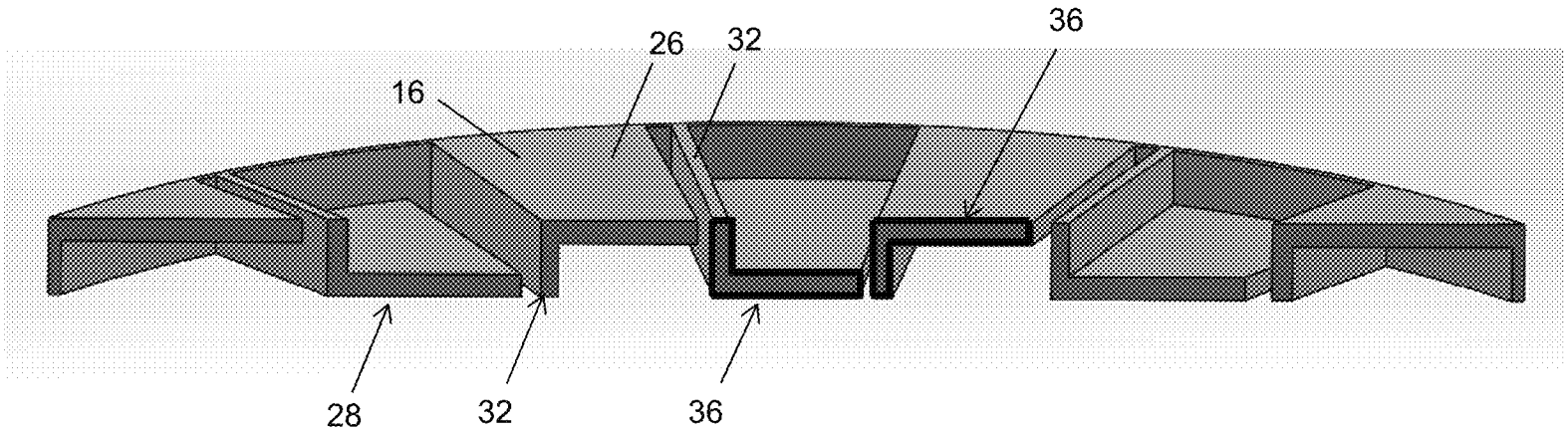

Various geometrical configurations with respect to the attachment of the ribs 32 to the side wall 16, in association with the slits 30, may be employed. For example, each rib 32 may be disposed between two adjacent slits 30. In FIGS. 2(*a*) and 2(*b*), each radial rib 32 is disposed between two radial slits 30. Furthermore, the ribs 32 connected to the side wall 16 may exhibit a T-configuration as shown in FIGS. 3(*a*), 3(*b*) and 3(*c*), or an L-configuration as shown in FIGS. 4(*a*), 4(*b*) and 4(*c*). The structure of the hub is omitted for clarity from FIGS. 3(*a*), 3(*b*), 3(*c*), 4(*a*), 4(*b*) and 4(*c*).

The T-configuration is so named, and defined, by the T-shaped cross-sectional profile 34 illustrated in FIG. 3(*c*) when a cross-section through the side wall 16 is viewed. The T-shaped cross-sectional profile 34 is due to the location of attachment of the ribs 32 to the side wall 16 between two slits 30 that is substantially equidistant between the two slits 30.

The L-configuration is so named, and defined, by the L-shaped cross-sectional profile 36 illustrated in FIG. 4(*c*) when a cross-section through the side wall 16 is viewed. The L-shaped cross-sectional profile 36 is due to the location of attachment of the ribs 32 to the side wall 16 between two slits 30 that is substantially asymmetrical between the two slits 30 so as to be located immediately adjacent to one of the two slits 30.

Preferably, all of the ribs 32 are provided with the same connection configuration with the side wall 16. In other words, in accordance with a preferred embodiment (FIG. 3(*a*)), all of the ribs 32 connected to the side wall 16 have the T-configuration, and in accordance with another preferred embodiment (FIG. 4(*a*)), all of the ribs 32 connected to the side wall 16 have the L-configuration. However, it is possible, in accordance with the present invention, for some of the ribs connected to the side wall to have the T-version configuration and some of the ribs connected to the side wall to have the L-version configuration.

In accordance with another aspect of the present invention, flange 10 comprises a plurality of spaced apart wedges or segments 31 separated from each other by openings or slits 30. Segments 31 are distributed throughout side wall 16 and may have substantially the same size or different sizes. At least one segment 31 has at least one rib 32 attached thereto to enhance the structural strength of segments 31. The rib can be attached in a T-configuration or an L-configuration discussed above. Segments 31 may have more than one rib 32. Slits 30 defining segments 31 may be linear and angular, curvilinear, or linear, but form an angle other than zero with angular lines from the center of flange 10 to outer rim 14, as discussed above and shown in FIGS. 6, 7 and 8.

As evident from FIGS. 2(*b*) and 2(*c*), the wire face of the hub 12 may be provided with a plurality of tab members 38 disposed proximate to middle rim 24 so that each tab member 38 extends away from the wire face of the hub portion 12. Each tab member 38, which may also be characterized as an undercut, includes a clip 40 that extends radially toward the outer rim 14 and a base portion 42 connecting the clip 40 to the hub 12. The tab members 38 are configured to snap fit, using the clip 40 into a corresponding receiving hole at either end of the tube or barrel so that a flange 10 is readily attached to the ends of the tube to assemble the reel or spool. Thus, once assembled, a flange 10 will be snap fitted to each end of the tube so the assembled reel or spool will include two flanges 10 fastened to the tube.

Apertures 44 formed partially in the hub 12 and possibly partially in the side wall 16 of the flange 10 are associated with tab members 38 so that a retracting pin in the mold can be used to form the undercut formed by clip 40 during manufacturing of the flange 10. In particular, flange 10 may be manufactured as a single-piece flange made of molded plastic, such as by injection molding or compression molding. In order to separate the single-piece molded plastic flange from the mold without damaging the tab members 38, a retracting pin is inserted through the apertures 44 to form a pocket for clip 40 and is retracted before the mold is opened.

In the alternative, the hub may be attached to the tube of the reel or spool using apertures supported by bosses as disclosed in commonly-owned U.S. Pat. No. 8,640,981 B2, which is incorporated herein by reference in its entirety, in accordance with an alternate flange embodiment. Thus, in accordance with one alternate flange embodiment, screws and nuts are used to fasten one flange to each end of the tube of the reel or spool. This alternate flange embodiment, then, has a slightly different hub structure in that its hub does not employ a plurality of tab members 38 and any structures associated with the tab members 38. In yet another alternative embodiment, the hub 12 may be attached to the tube of the reel or spool by spin welding as disclosed in U.S. Pat. No. 3,501,110 to Hopgood et al, which is incorporated herein by reference in its entirety.

The hub 12 or barrel can have any diameter suitable for the wires to be wound, and the present invention is not limited to any particular hub design. However, when the hub 12 is provided with the plurality of tab members 38, tab members 38 are preferably hollow to define cups 46 formed in their base portions 42 as shown in FIG. 2(*a*). Cups 46 are adapted to receive fingers of a machine that rotates the assembled reel or spool to reel-in the cables or wires.

In accordance with another aspect of the present invention, side wall 16 may further include a plurality of arc-shaped walls 48 extending between the outer face 26 and the wire face 28 so each arc-shaped wall 48 defines a first aperture portion 50 of a substantially circular window 52. Windows 52 are provided in the flange 10 so that the amount of wire or cable remaining on the assembled reel or spool may be ascertained by visual or electronic inspection through the windows 52. The remaining wires or cables can also be viewed through slits 30.

In accordance with another aspect of the present invention, the outer face of the hub 12 may be provided with a plurality of nibs 62 arranged on the outer face preferably in a circular pattern, as shown in FIG. 2(*a*). Nibs 62 extend away from the outer face of the hub 12, and perform an alignment function for stacking multiple flanges 10 on top of each other and/or during assembly of the flange 10 to the tube or barrel.

In accordance with another aspect of the present invention, as shown in FIG. 2(*b*), the hub 12 may be provided with a plurality of ribs 64 that extend between the base portion 42 of the tab members 38 and the inner rim 60 in order to improve the structural integrity of the huh 12. Ribs 32 and 64 help to ensure that the outer face of the flange 10 and the wire face of the flange are preferably substantially planar. When rotated at high speeds, for example, when cables or wires are wound onto the reel or spool, substantially flat or planar flanges 10 minimize any rotational vibrations on the reel or spool. Rotational vibrations may decrease the rate of intake of cables or wires.

Figure 5:
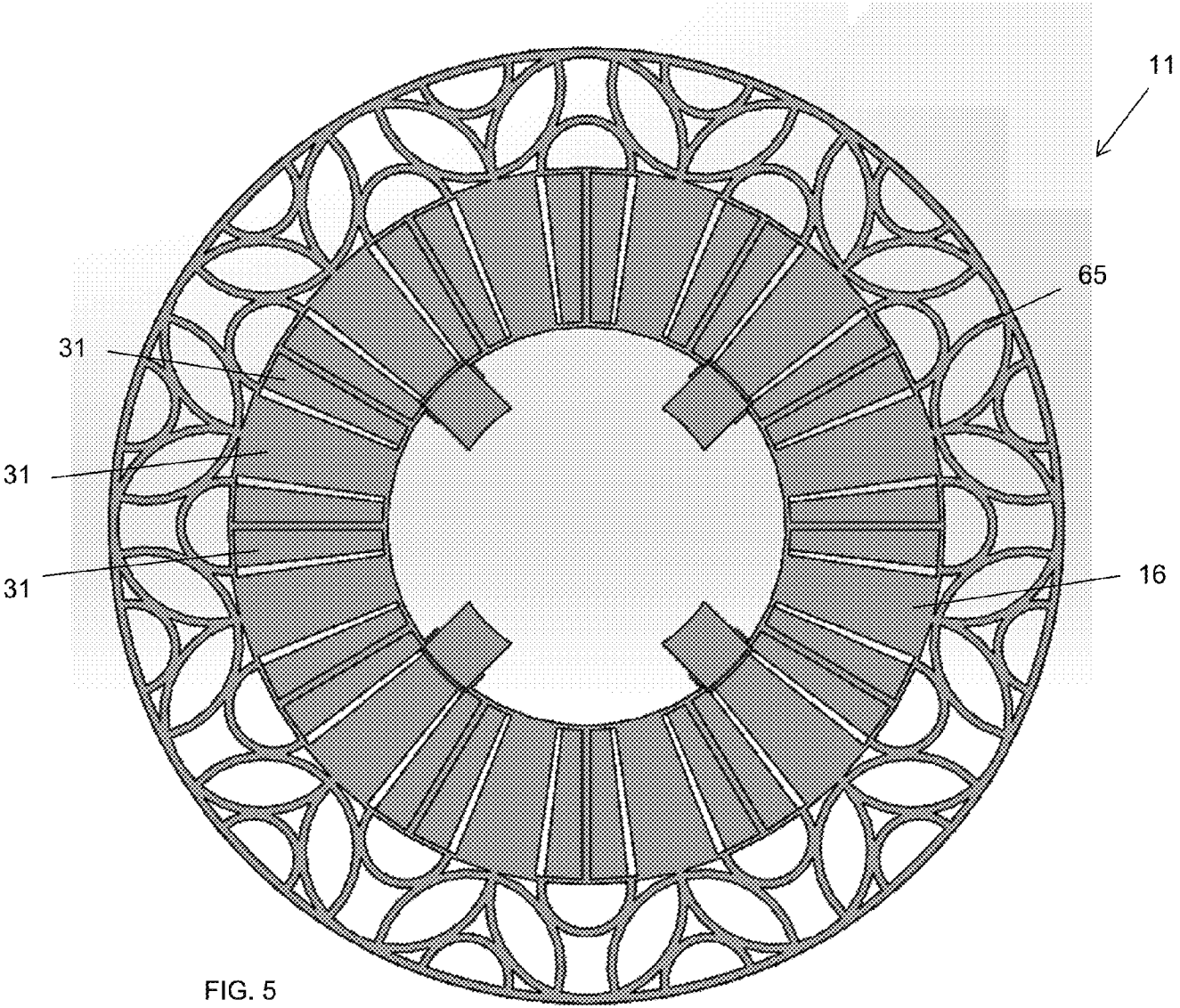
FIG. 5 is a top view illustrating another embodiment of the present invention that includes an abstract connected to the outer rim of the flange (structure of the hub omitted for clarity)

In accordance with another aspect of the present invention, as shown in FIG. 5, the flange 10 may be provided with an abstract 65 or other ornamental designs connected to the outer rim 14. The abstract 65 extends the outer circumference of the flange to that corresponding to a larger diameter than the circumference associated with the diameter of the side wall, which allows the flange to accommodate more wire or cable when assembled as part of a reel or spool. However, the abstract 65 has a reticulated structure that adds relatively minimal mass to the flange compared to the increase in storage volume obtained by the reel or spool. The abstract 65 may be integrally molded as a component of a single-piece flange 11 made by injection molding plastic.

Figure 9:
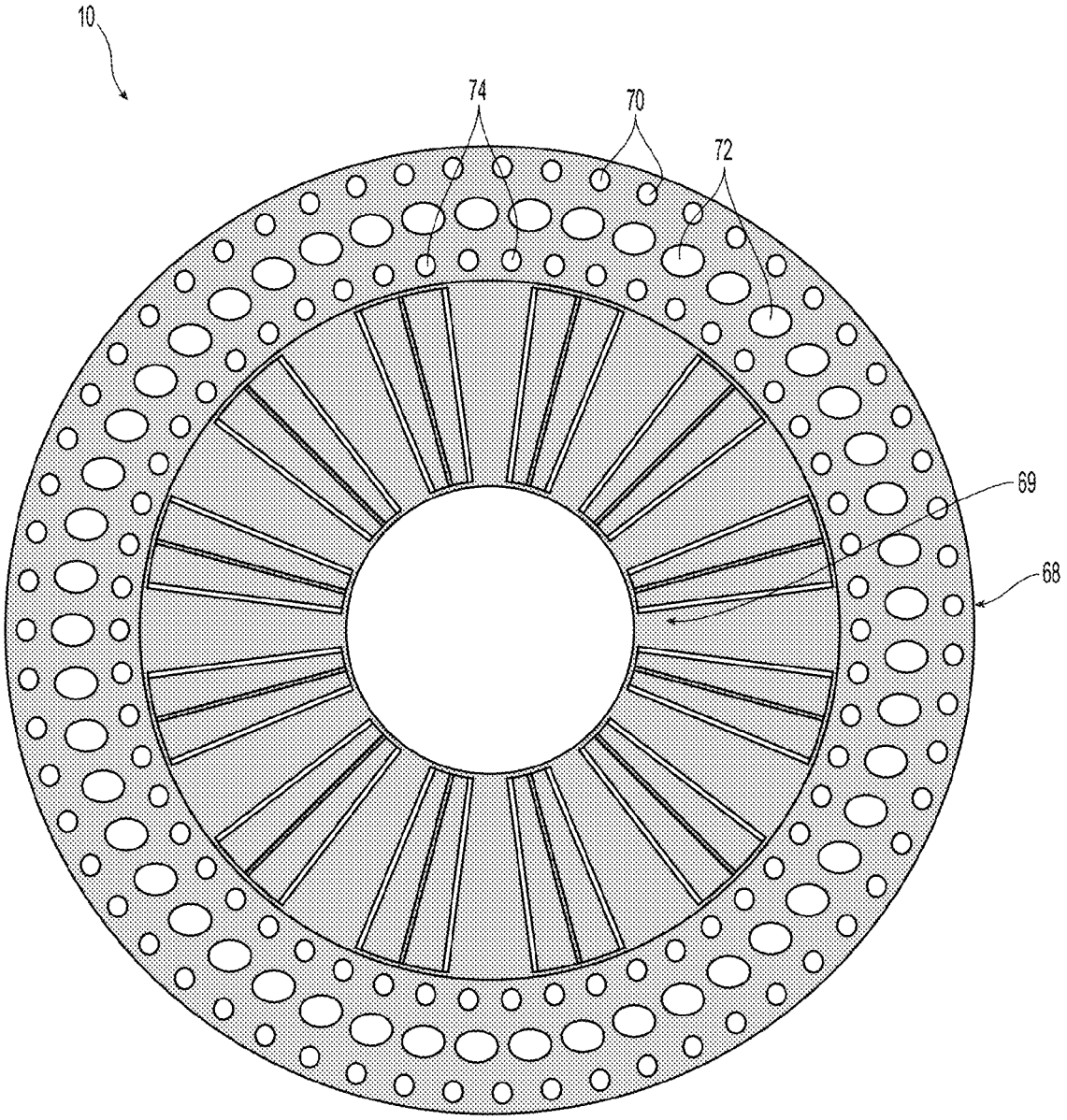
FIG. 9 is a top view illustrating another embodiment of the present invention employing holes arranged to form a region of high concentration of crack propagation inhibitors.

Because cracks may tend to originate at the outer rim 14 and propagate inwards, in accordance with another aspect of the present invention, other crack propagation inhibitors may be distributed unevenly on the side wall 16 so there is a high concentration region 68 of crack propagation inhibitors located towards the periphery of the side wall 16 proximate outer rim 14 and either no crack propagation inhibitors or a low concentration of propagation inhibitors in the region 69 proximate middle rim 24 as shown in FIG. 9. Preferably, region 68 occupies an area defined by about the outer half of a radius from middle rim 24 to outer rim 14 (i.e., an outer half radial portion), and preferably an outer third or more (i.e., an outer third radial portion), and preferable an outer quarter of the radius (i.e., an outer fourth radial portion) of the side wall 16. Such a high concentration region 68 of crack propagation inhibitors may be characterized as a crumble or crumple zone. According to the embodiment of FIG. 9, the crumble or crumple zone has the configuration of a ring adjacent to the outer rim 14, and optionally the thickness of the side wall 16 within the crumble or crumple zone may be greater than, or less than, the thickness of the side wall 16 outside of the crumble or crumple zone in order to affect how cracks propagate in the crumble or crumple zone. In an alternate embodiment of the present invention, the crumble or crumple zone has the configuration of a segmented ring made up of a plurality of separate sectors comprising arcs of less than 180 degrees and more than 10 degrees. For example, arcs of about 20 degrees, about 30 degrees, about 40 degrees, about 50 degrees, about 60 degrees and about 90 degrees constitute non-limiting examples in which the discontinuous ring is made up of 18, 12, 9, 7, 6 and 4 sectors respectively. Each of these sectors is separated from its neighboring sectors by a distinct boundary region that does not include a crack propagation inhibitor of the type defining the separate sectors of the crumble zone. Each boundary region may include one or more ribs attached to the side wall 16.

In the embodiment illustrated in FIG. 9, the crack propagation inhibitors are represented by holes 70 of a first diameter and holes 72 of a second diameter and holes 74 of a third diameter, wherein the first diameter is smaller than or equal to the second diameter, and the third diameter is smaller than or equal to the second diameter. Of course, the size of the holes 70, 72 and 74 may all be the same, or the size of holes 70 and 74 may be the same but different from the size of holes 72. In accordance with one aspect of the present invention, the holes 70 and 74 are each arranged on a respective first and second circumference and have the same diameter, and the holes 72 are arranged on a third circumference that is between the first and second circumferences, and holes 72 have a diameter that is larger than the diameters of holes 70 and 74. In accordance with another aspect of the invention, the third diameter of holes 74 is larger than the second diameter of holes 72, and the second diameter of holes 72 is larger than the first diameter of holes 70. In accordance with another aspect of the invention, the first diameter of holes 70 is larger than the second diameter of holes 72, and the second diameter of holes 72 is larger than the third diameter of holes 74.

While holes 70, 72 and 74 have been illustrated as circular in shape, they may be non-circular. Other suitable shapes include oval shapes and more elongated slits. The high concentration region 68 may include other kinds of crack propagation inhibitors in place of, or in addition to, holes 70, 72 and 74, such as slits 30. The embodiment of FIG. 9 can be used with flanges with ribs discussed above, or with flanges with corrugations, as described in U.S. Pat. No. 8,640,981 B2. Other crack propagation inhibiting structures, such as the plurality of spaced apart wedges or segments 31 described above, may be dimensioned and configured so they are limited to the high concentration region 68 proximate the outer rim 14 instead of having a substantially uniform arrangement on the side wall 16.

The molded material used to make the single-piece flange 10 of the present invention may be selected from various possible materials depending on the particular operational requirements of the flange. Examples of molded materials used to make the flange 10 include suitable thermoset or thermoplastic material, such as polypropylene, high impact polystyrene, or acrylonitrile/butadiene/styrene. A particularly useful material from which a single-piece flange of the present invention is molded is reprocessed high density polyethylene (reprocessed HDPE). Any of these materials may be modified with additives such as talc, calcium carbonate, and the like, in order to enhance particular properties of the material.

While it is apparent that the illustrative embodiments of the invention disclosed herein fulfill the objectives stated above, it is appreciated that numerous modifications and other embodiments may be devised by those skilled in the art. Furthermore, features from one or more embodiments can be used with features from other embodiments. Therefore, it will be understood that the appended claims are intended to cover all such modifications and embodiments, which would come within the spirit and scope of the present invention.

CHARACTER REFERENCES

10 flange (one embodiment)
11 flange (another embodiment)
12 hub or core
14 outer rim
16 side wall
18 arbor
20 aperture (arch-shaped)
24 middle rim
26 outer face
28 wire face
30 crack propagation inhibitors
31 segment
32 ribs of the sidewall.
34 profile of T-configuration
36 profile of L-configuration
38 tab member
40 clip
42 base portion of tab member
44 aperture associated with tab member
46 cups
48 arc-shaped wall
50 first aperture portion of window
52 window (substantially circular)
58 arched wall
60 inner rim of arbor
62 nibs
64 hub ribs
65 abstract
68 region of high concentration of propagation inhibitors
69 region of low concentration of propagation inhibitors
70 hole having a first diameter
72 hole having a second diameter

74 hole having a third diameter
180 reel
181 axis of rotation
182 tube
184 flange
188 ribs
198 ribs

I claim:

1. A single-piece flange adapted to be a part of a reel or spool, wherein the flange comprises:

a hub portion defining one or more apertures;

an outer rim;

a side wall disposed between the hub portion and the outer rim, wherein the side wall comprises an outer face and a wire face, and a plurality of crack propagation inhibitors comprising elongated slits extending through a thickness of at least the side wall and terminating before or at the hub portion; and a plurality of ribs connected to the side wall, and extending toward the hub portion.

2. The single-piece flange of claim 1, wherein each rib has one longitudinal unattached edge.

3. The single-piece flange of claim 1, wherein each elongated slit comprises a radial slit, wherein each rib is disposed between two radial slits.

4. The single-piece flange of claim 3, wherein some radial slits of the plurality of crack propagation inhibitors have a different length than other radial slits of the plurality of crack propagation inhibitors.

5. The single-piece flange of claim 1, wherein the hub portion comprises an outer face and a wire face, wherein the hub portion includes an arbor that defines a central aperture having a first circumference and a middle rim having a second circumference that is greater than the first circumference, and a plurality of tab members disposed on the wire face of the hub portion between the central aperture and the middle rim, and extending away from the wire face of the hub portion.

6. The single-piece flange of claim 5, wherein each tab member comprises a clip that extends radially towards the outer rim.

7. The single-piece flange of claim 6, wherein the tab members are adapted to receive a barrel for a wire to be wound thereon.

8. The single-piece flange of claim 5, wherein a plurality of nibs are disposed on the outer face of the hub portion and extend away from the outer face of the hub portion.

9. The single-piece flange of claim 1, wherein at least one rib is connected to the side wall in a configuration selected from the group consisting of a T-configuration and an L-configuration.

10. The single-piece flange of claim 1, wherein some ribs of the plurality of ribs have a different length than other ribs of the plurality of ribs.

11. The single-piece flange of claim 1, further comprising an abstract comprising a reticulated structure, wherein the abstract is connected to the outer rim.

12. The single-piece flange of claim 1, wherein the plurality of crack propagation inhibitors divide the side wall into a plurality of discrete crack propagation inhibiting segments or webs, wherein a crack forming in the side wall of one discrete crack propagation inhibiting segment or web is prohibited from propagating into an adjacent discrete crack propagation inhibiting segment or web by one or more crack propagation inhibitors.

13. The single piece flange of claim 12, wherein the segments or webs are arranged in an alternating manner.

14. The single-piece flange of claim 1, wherein the plurality of crack propagation inhibitors are distributed uniformly on the side wall of the flange.

15. The single-piece flange of claim 1, further including a plurality of holes formed through the side wall and arranged in a plurality of concentric rings on the side wall.

16. The single-piece flange of claim 15, wherein the plurality of holes are located on an outer third radial portion or on an outer fourth radial portion of the side wall.

17. A single-piece flange adapted to be a part of a reel or spool, wherein the flange comprises:

a hub portion defining one or more apertures;

an outer rim;

a side wall disposed between the hub portion and the outer rim, wherein the side wall comprises an outer face and a wire face, and a plurality of crack propagation inhibitors comprising elongated slits extending through a thickness of at least the side wall; and a plurality of ribs connected to the side wall, and extending toward the hub portion wherein the plurality of ribs include a plurality of first ribs and a plurality of second ribs, wherein each first rib is connected to the outer face of the side wall, and each second rib is connected to the wire face of the side wall.

18. The single-piece flange of claim 17, wherein at least one rib is connected to the side wall in a configuration selected from the group consisting of a T-configuration and an L-configuration.

19. A single-piece flange adapted to be a part of a reel or spool, wherein the flange comprises:

a hub portion defining one or more apertures;

an outer rim;

a side wall disposed between the hub portion and the outer rim, wherein the side wall comprises an outer face and a wire face; and a plurality of spaced apart wedges or segments separated from each other by a plurality of crack propagation inhibitors extending through a thickness of at least the side wall and terminating before or at the hub portion, wherein each wedge or segment has at least one rib attached thereto.

20. The single-piece flange of claim 19, wherein the at least one rib of each wedge or segment has a T-configuration.

21. The single-piece flange of claim 19, wherein the at least one rib of each wedge or segment has an L-configuration.

22. The single-piece flange of claim 19 further comprises:

a crumble or crumple zone on said side wall comprising a plurality of holes extending through a thickness of at least the side wall.

23. The single-piece flange of claim 19, wherein the plurality of spaced apart wedges or segments is arranged in an alternating manner.

* * * * *